United States Patent [19]

Nickels, Jr.

[11] 4,160,559

[45] Jul. 10, 1979

[54] REINFORCE TEE SECTION FOR CHIMNEY

[75] Inventor: Joseph J. Nickels, Jr., Kalamazoo, Mich.

[73] Assignee: Van-Packer Co., Beach Haven, N.J.

[21] Appl. No.: 803,813

[22] Filed: Jun. 6, 1977

[51] Int. Cl.[2] ..... F16C 11/06; F16D 1/12; F16J 1/16

[52] U.S. Cl. ..... 285/156; 285/189; 285/424

[58] Field of Search ..... 285/156, 155, 188, 189, 285/192, 114, 150, 424; 126/307 R; 98/58, 60

[56] References Cited

U.S. PATENT DOCUMENTS

| | | | |
|---|---|---|---|
| 1,013,009 | 12/1911 | Graham | 285/150 X |
| 1,978,609 | 10/1934 | Straty | 285/189 |
| 1,980,818 | 11/1934 | Morrow | 285/156 X |
| 1,992,960 | 3/1935 | Miller et al. | 285/189 |
| 2,189,201 | 2/1940 | Flader | 285/150 X |
| 2,541,208 | 2/1951 | Cornelius | 285/156 |
| 2,963,783 | 12/1960 | Field | 285/189 |

FOREIGN PATENT DOCUMENTS

| | | | |
|---|---|---|---|
| 519027 | 3/1940 | United Kingdom | 285/210 |

*Primary Examiner*—Wayne L. Shedd
*Attorney, Agent, or Firm*—Henderson & Sturm

[57] ABSTRACT

A chimney section including a jacket having a breech aperture. A breech assembly is affixed to the jacket over the breech aperture. A reinforcement assembly further interconnects the jacket and breech assembly. The reinforcement assembly includes a shroud having a planar portion which is elongated and is tapered at each end thereof. A plurality of side members join the planar member to the jacket. The breech assembly extends through the planar member.

8 Claims, 8 Drawing Figures

REINFORCE TEE SECTION FOR CHIMNEY

BACKGROUND OF THE INVENTION

This invention relates generally to sections of chimneys employed with boilers, incinerators, generators and other industrial/commercial appliances. More particularly, this invention relates to chimney sections, such as tee sections, which are breeched to provide for a connection between the chimney and the appliance.

Generally, at least one chimney section, usually having a clean-out door, will be disposed below the tee section. A number of sections will be disposed above the tee section. Chimneys used for commercial and industrial applications quite often are tall, rising to heights in excess of one hundred feet (30.5 meters). A large number of chimney sections, therefore, must be supported above the tee section. The breech aperture formed in the tee section weakens the tee section and renders more difficult the problem of supporting the chimney sections above. While collateral support structures, such as braces extending between adjoining buildings, or the ground, and the chimney, may be employed, such structures are awkward and space consuming. It is preferable that the chimney itself be adequately self-supporting.

SUMMARY OF THE INVENTION

A chimney section includes a jacket having formed through the side thereof a breech aperture. A breech assembly is attached to the jacket over the breech aperture. The breech assembly may be circular or rectangular in cross section.

A reinforcement assembly includes a shroud. The shroud has a planar portion through which the breech assembly extends. Side portions are affixed to the planar portion about the periphery thereof and connect the planar portion to the jacket. A plurality of stiffener members may be affixed to the side portions.

It is an object of this invention to provide a superior chimney tee section for use with industrial and commercial chimneys.

Another object of this invention is to provide a chimney tee section of superior strength, able to support a large number of chimney sections extending thereabove.

It is also an object of this invention to provide a structure which will render a chimney section strong, even though breeched, to provide for connecting an appliance to a chimney, such that a large number of chimney sections may be supported thereabove.

Yet another object of this invention is to provide a chimney section which will aid in supporting the structures joining the appliance and chimney as well as the chimney itself.

A further object of this invention is to provide a chimney tee section which will be economical to construct, requiring no special tooling for the manufacture thereof, yet capable of accomplishing the aforementioned objects.

These objects and other features and advantages of the chimney section of this invention will become readily apparent upon referring to the following description, when taken in conjunction with the appended drawing.

BRIEF DESCRIPTION OF THE DRAWING

The chimney section of this invention is illustrated in the drawing wherein.

DESCRIPTION OF THE PREFERRED EMBODIMENT

Figure 1:
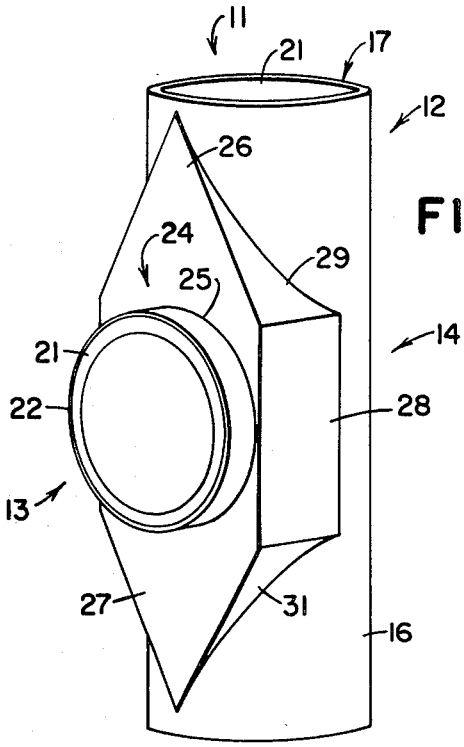
FIG. 1 is a perspective view of the chimney section.

The chimney section of this invention is indicated generally at 11 in FIG. 1. More particularly, the chimney section 11 includes a jacket assembly 12, a breech assembly 13 and a reinforcement assembly 14.

Figure 4:
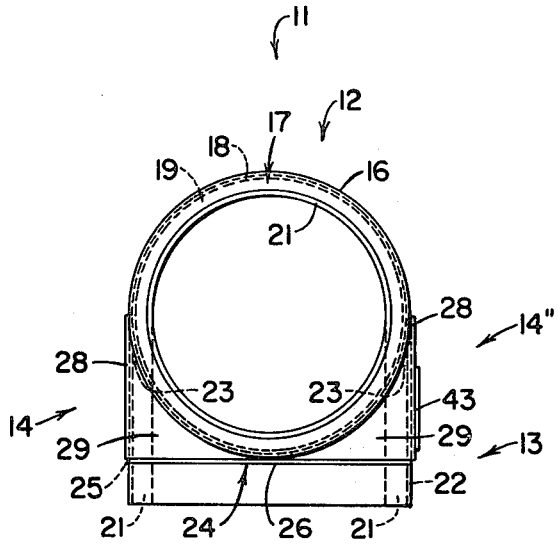
FIG. 4 is a top plan view of the chimney section, showing both the preferred and alternate embodiment of the reinforcement assembly thereof depicted in FIG. 2.
Figure 3:
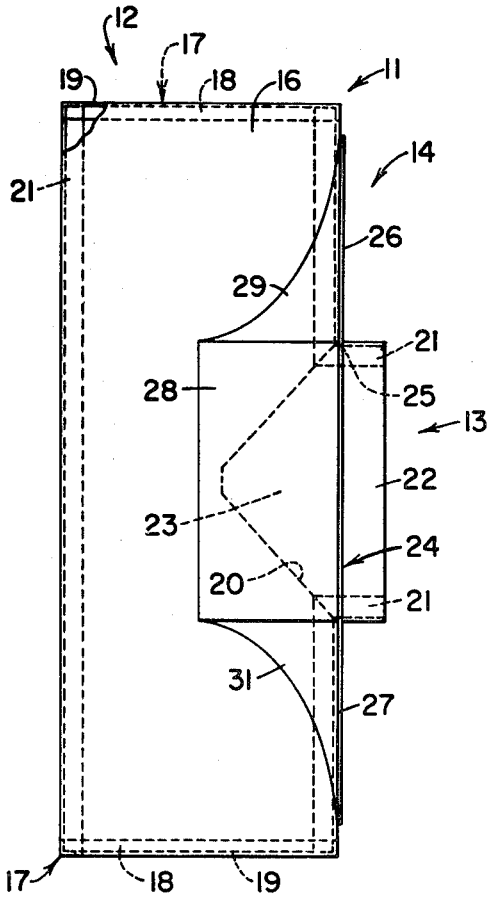
FIG. 3 is a side elevational view, a portion of the chimney section being cut away to more clearly show internal structures thereof.

Referring now to FIGS. 3 and 4, the jacket assembly 12 includes a jacket 16. The jacket 16 is elongated and cylindrical in conformation, being hollow and open at both ends. Attached to the interior of the jacket 16, adjacent each end thereof, are internal rings 17. Each ring 17 is L-shaped in cross section, having a first flange portion 18 which is affixed to the inside surface of the jacket 16 and a second flange portion 19 which is joined normal to portion 18 and extends therefrom into the interior space of the jacket 16. A breech aperture 20 is formed in the jacket 16, intermediate the ends thereof, to provide access to the interior of the jacket 16. A refractory lining 21 is disposed against the interior surface of the jacket 16.

The breech assembly 13 (FIGS. 2 and 3) includes a cylindrical portion 22. Contiguous with the cylindrical portion 22 are side tapering areas 23. The breech assembly 13 is fitted over the breech aperture 20, the side tapering areas 23 being affixed to the outside surface of the jacket 16 and the longitudinal axis of the cylindrical portion 22 being disposed normal to the longitudinal axis of the jacket 16. The portion 22 extends away from the jacket 16. The refractory lining 21 is continued against the interior surface of the cylindrical portion 22.

Figure 2:
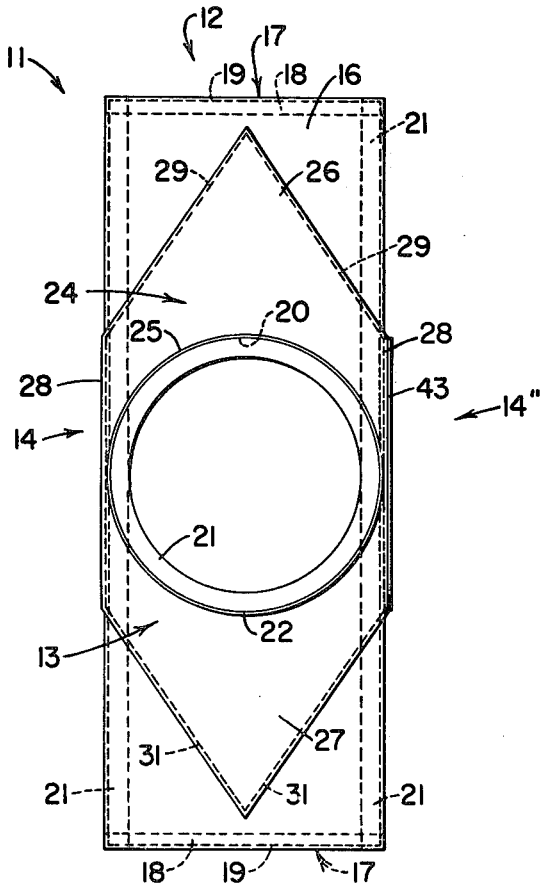
FIG. 2 is a front elevational view of the chimney section, showing both the preferred and an alternate embodiment of the reinforcement assembly thereof.

The reinforcement assembly 14 includes a planar surface portion 24 (FIG. 2). The portion 24 has a central aperture formed therethrough at 25 and has upper and lower tapering ends 26, 27. The assembly 14 also includes, as shown in FIGS. 1 and 3, intermediate side portions 28, which are substantially rectangular in conformation, and upper and lower side portions 29, 31, which are somewhat triangular in conformation. The side portions 28, 29, 31 are affixed normal to, about the periphery of, the planar surface portion 24. The side portions 28 are centered on, and disposed on opposite sides of, the aperture at 25. The side portions 29 are disposed along the edges of the upper end 26, and the side portions 31 are disposed along the edges of the lower end 27. The reinforcement assembly 14 is fitted over the breech assembly 13, the cylindrical portion 22 being received through the aperture at 25 and being disposed normal to planar surface 24. The sides 28, 29, 31 extend between the exterior surface of the jacket 16 and the planar surface 24.

Figure 5:
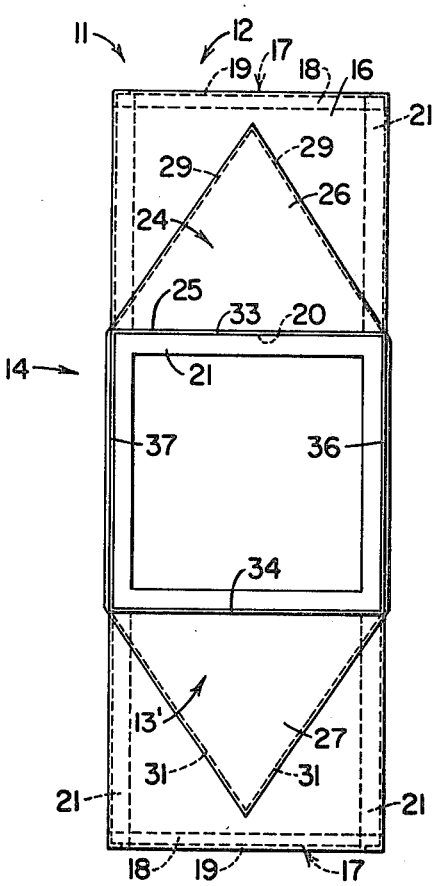
FIG. 5 is a fragmentary, front elevational view illustrating a modification of the breech assembly of the chimney section.

A first modification of the chimney section 11 is illustrated in FIG. 5. A modified breech assembly 13' includes a rectangular portion 32 having upper, lower, right and left sides 33, 34, 36, 37. The right and left sides 36, 37 are contiguous with side tapering areas not shown, but similar in conformation to, areas 23.

Figure 8:
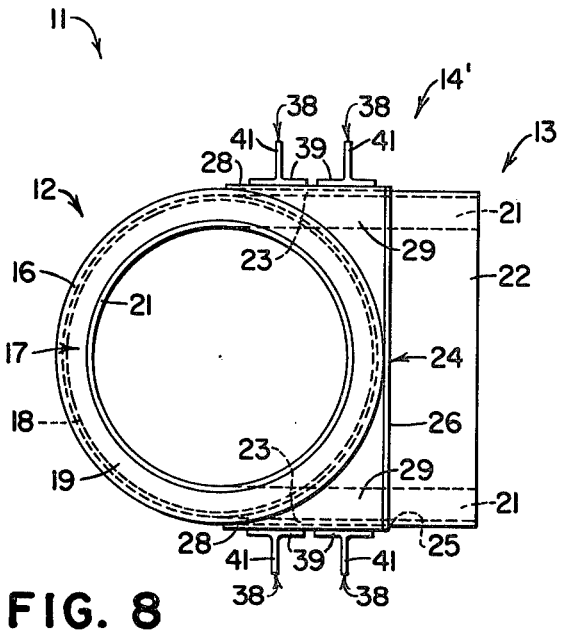
FIG. 8 is a top plan view showing the modification of the reinforcement assembly of the chimney section depicted in FIGS. 6 and 7.
Figure 7:
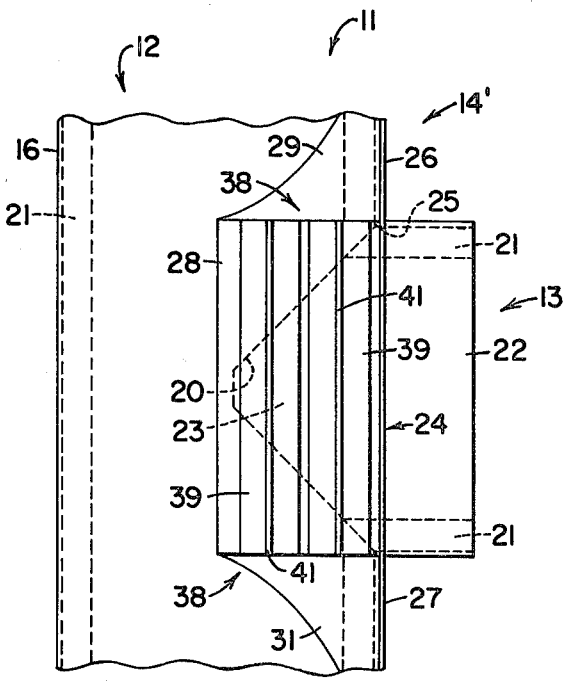
FIG. 7 is a fragmentary, side elevational view showing the modification of the reinforcement assembly of the chimney section depicted in FIG. 6.
Figure 6:
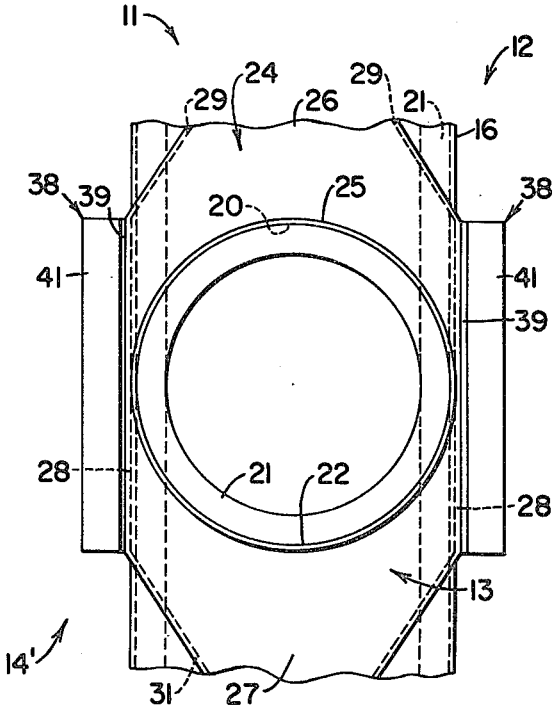
FIG. 6 is a fragmentary, front elevational view illustrating another modification of the reinforcement assembly of the chimney section.

A second modification of the chimney section 11 is illustrated in FIGS. 6, 7 and 8. A modified reinforcement assembly 14' includes a plurality of stiffener members 38. Each stiffener 38 has first and second elongated members 39, 41, the second member 41 being affixed normal to, and intermediate the longitudinal edges of, the first member 39 to provide the stiffener 38 with a T-shaped cross section. The stiffeners 38 are affixed to the rectangular sides 28, the first members 39 being attached to the sides 28 and the second members 41 being directed away from the sides 28. The stiffeners 28 are oriented such that the longitudinal axes thereof are parallel with respect to each other and with respect to the longitudinal axis of the jacket 16 and are normal to the longitudinal axis of the portions 22 or 32.

A third modification of the chimney section 11 is illustrated in FIGS. 2 and 4. A modified reinforcement assembly 14" includes a pair of small plates 43. The small plates 43 are rectangular in conformation, having a longitudinal dimension substantially the same as that of the intermediate side portions 28, but having a transverse dimension smaller than that of the portions 28. A small plate 43 is affixed to each side portion 28, the longitudinal axes of the portion 28 and plate 43 being disposed in parallel. The small plates 43 are attached to the half-portions of the portions 28 which are disposed adjacent to the planar surface 24.

Generally when the chimney section 11 is formed, the jacket 16 is made from a suitable material such as steel. The jacket 16 may be made by welding together two steel plates that have been formed into an arcuate shape. The internal rings 17 are then attached, as by welding. The refractory lining 21 is then formed against the interior surface of the jacket 16. Thereafter the breech aperture 20 is formed in the jacket 16, being cut to display a circular or rectangular conformation when viewed along the longitudinal axis of the breech assembly 13 or 13' (as shown in FIGS. 2 and 5 respectively). The breech aperture 20 is cut such that, again when viewed from the direction of FIGS. 2 and 5, the dimensions thereof are greater than or equal to the internal dimensions, but smaller than the external dimensions, of a cross section of the portions 22 or 32.

The breech assembly 13 or 13' is generally of a suitable material, again such as steel, and also may be fabricated by welding together halves suitably formed from metal plates and thereafter lined with refractory material 21. Cuts are made in one end to form the tapering areas 23, and the arcuate edges therebetween (not shown), of assembly 13 or 13'. The aperture 20 has been so cut that, when the assembly 13 or 13' is attached to the jacket 16, the tapering areas 23, and arcuate edges therebetween (not shown), are disposed against the exterior surface of the jacket 16.

The chimney section 11 is employed in a chimney, normally adjacent the lower end to connect an appliance, such as a boiler, with the chimney. Structures leading from the appliance are connected to the breech assembly 13 or 13'. Other conformations may be employed for the breech aperture and breech assembly such that different types of appliances may be accommodated.

The chimney section 11 is connected to sections immediately above and below by joining the ends of the jacket 16, as by welding, to adjacent ends of the sections. The end rings 17 are also of aid in that the second flange portions 19 thereof are disposed flush with the opening of the jacket 16 and are thereby readily accessible for jointure to similar structures of other sections. A large number of chimney sections may be supported by section 11, despite the breech aperture 20 formed in the side of the jacket 16, because of the strengthening provided by the reinforcement assembly 14. The reinforcement assembly 14 also aids in supporting the breech assembly 13 or 13' and therefore connecting structures of the appliance. The modified assemblies 14', 14" provide greater strengthening of the jacket assembly 12.

The fabrication of the chimney section 11 does not require the acquisition of any special or unique tooling, but rather a manufacturer of components for chimneys would already have all tooling necessary. Although a preferred embodiment and modifications thereof have been disclosed herein, it is to be remembered, that various further modifications and alternate constructions can be made thereto without departing from the full scope of the invention, as defined in the appended claims.

I claim:

1. A chimney section comprising:

jacket means being elongated, hollow and having open ends, said jacket means having a breeching aperture formed through a side thereof, said jacket means having a cylindrical conformation;

breech means being elongated, hollow and having open ends, said breech means being attached to said jacket means over said breeching aperture, one of said breech means open ends communicating with said breeching aperture, said breech means having first and second portions, said first portion engaging and partially encircling said jacket means, said second portion being contiguous with said first portion and extending outwardly away from said jacket means; and reinforcement means for strengthening and supporting said jacket means and said breech means, said reinforcement means including first and second means for stress transfer, said first means being elongated in the direction of said jacket means' elongation and having a supporting aperture formed therethrough, said second means being attached about the periphery of said first means, said reinforcement means being attached over said breech means, said breech means being received through said supporting aperture, said second means interconnecting said jacket means and said first means, said second portion being received through said supporting aperture and supported by said first means, said first means being substantially planar and having a rectangular central portion and end portions, each end portion being contiguous with, and disposed on opposite sides of, said rectangular portion, each end portion extending away from said central portion, and having side surfaces which meet, toward a jacket means' end, said supporting aperture being formed through said central portion, said second means including central and end side members, said central side members being affixed normal to, and adjacent the longitudinal edges of, said central portion, said end side members being affixed normal to, and adjacent said side surfaces of, said end portions, said central and end side members being disposed to the same side of said first means and being attached to said jacket means.

2. A chimney section as defined in claim 1 and further wherein said supporting aperture is circular in conformation, said second portion having a circular cross section.

3. A chimney section as defined in claim 1 and further wherein said supporting aperture is rectangular in conformation, said second portion having a rectangular cross section.

4. A chimney section as defined in claim 1 and further wherein said reinforcement means includes a plurality of stiffener means, each stiffener means having first and second members, said second member being attached normal to said first member, said first members being affixed to said central side members, said second members extending away from said central side members and being disposed parallel to said first means.

5. A chimney section as defined in claim 1 and further wherein said reinforcement means includes a plurality of stiffener means, each stiffener means being elongated and affixed to one of said central side members, the longitudinal axes of said central side member and said stiffener means being disposed in parallel, said stiffener means being disposed upon said central side members adjacent said first means.

6. A reinforcement structure for use with a chimney tee section, the section including a jacket having a breech aperture formed in the side thereof and a breech member attached to the jacket over the breech aperture, said reinforcement structure comprising:

first means for stress transfer, said first means being elongated in the direction of the jacket's elongation, substantially planar and having central and end portions, said central portion having an aperture formed therethrough, said end portions being contiguous with said central portion and disposed on opposite sides of said aperture, each end portion extending away from said central portion in the direction of the jacket's elongation and having side surfaces which meet at a location remote from said central portion, whereby said end portions are tapered;

second means for stress transfer, said second means including central and end side members, said central side members being affixed to, and adjacent each longitudinal edge thereof, said central portion, said end side members being affixed to, and adjacent said side surfaces of, said end portions;

said central and end side members being disposed to the same side of said first means, the longitudinal axes of said first means and the jacket being disposed in parallel, the breech member being received through said aperture, said central and end side members being affixed to the jacket, whereby the jacket is strengthened and the breech member supported.

7. A reinforcement structure as defined in claim 6 and further wherein said second means for stress transfer including a plurality of stiffener means, each stiffener means having first and second members, said second member being affixed normal to said first member, said first members being affixed to said central side members, said second members extending outwardly away from said central side members, the longitudinal axes of said stiffener means and said first means being disposed in parallel.

8. A reinforcement structure as defined in claim 6 and further wherein said second means for stress transfer includes a plurality of stiffener means, each stiffener means being elongated and affixed to one of said central side members, the longitudinal axes of said central side member and said stiffener means being disposed in parallel, said stiffener means being disposed upon said central side members adjacent said first means.

* * * * *